US007004210B1

(12) United States Patent
Wegman et al.

(10) Patent No.: US 7,004,210 B1
(45) Date of Patent: Feb. 28, 2006

(54) CONDITIONING TONER IN CARTRIDGE DURING AUGER FILLING

(75) Inventors: Paul M. Wegman, Pittsford, NY (US); Mikhail Vaynshteyn, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/224,564

(22) Filed: Sep. 12, 2005

(51) Int. Cl.
*B65B 1/04* (2006.01)

(52) U.S. Cl. ..... 141/256; 141/67; 141/73

(58) Field of Classification Search ..... 141/2, 141/18, 67, 69–74, 256
See application file for complete search history.

(56) References Cited

U.S. PATENT DOCUMENTS

| | | | | |
|---|---|---|---|---|
| 4,185,669 | A * | 1/1980 | Jevakohoff | 141/59 |
| 5,727,607 | A | 3/1998 | Ichikawa | |
| 6,497,259 | B1 | 12/2002 | Wegman | |
| 6,863,096 | B1 * | 3/2005 | Amano | 141/59 |
| 6,951,230 | B1 * | 10/2005 | Wegman | 141/256 |

* cited by examiner

*Primary Examiner*—Steven O. Douglas
(74) *Attorney, Agent, or Firm*—James J. Ralabate

(57) ABSTRACT

A toner-filling device that transports a toner mass from a hopper to a cartridge. A porous tube is used during the filling operation to remove air from or supply air to the toner. This porous tube will operate at various depths of toner to more completely remove air from or supply air to the toner. An auger is used to transport the toner, and the porous tube extends through the auger beyond the lowest end of the auger.

20 Claims, 4 Drawing Sheets

CONDITIONING TONER IN CARTRIDGE DURING AUGER FILLING

The presently disclosed embodiments are directed generally to an apparatus for filling a container and, more specifically, to an apparatus for filling a container with a particulate material such as Xerographic toner.

BACKGROUND

When photocopies were first used after the development and invention of xerography by Chester Carlson, generally a flat photosensitive surface was uniformly charged, exposed to an image, and developed by a developer or a toner. The toner was usually sprinkled across the photosensitive surface so that it would adhere in imagewise configuration and then transferred to a paper surface where it was fused to the paper as a fixed image. In those days, toner was housed in a toner housing having a volume capacity depending on the size of the copier machine. For example, the larger copier machines usually had larger toner bins while desk top smaller copiers had smaller toner bins.

Today, as some copiers are made smaller and more compact, there is a need for using toner cartridges containing toner as dense in total volume as practical, and with a small cartridge. The small cartridge allows less space to be occupied in a small copier, the densely packed toner permits as much usable toner available within this smaller cartridge.

It is, therefore, important to have available a system for filling a cartridge with as much toner as practical and yet not interfere with the flowing properties of the toner during use in a photocopier. One method used to allow the toner cartridge to be filled to a higher density is to remove air from a toner mass during the filling of the cartridge with toner. Evacuating air from a toner mass by the use of a vacuum is a very effective means. By increasing the bulk density of the toners, it is possible to reduce the size of the toner cartridge. Also, packing as much toner in a given size cartridge provides a way to extend the useful life of the cartridge being used and lengthening the time between replacing the toner cartridge with a new fresh cartridge.

In U.S. Pat. No. 5,727,607 (Ichikawa) there is provided a means for suctioning air from the toner during the filling of a container. A section rod adjacent to the toner feed apparatus is inserted into a container through an opening in the container. This suction rod has an end connected to a suction pump while the other end of the rod is provided with a mesh filter that allows suction of the air from the toner accumulated in the container. In the Ichikawa filling process, the opening in the container through which the section rod is inserted provides a means to use a deaerating device to remove air from a toner mass. Ichikawa, in an augerless toner filling system, uses a porous aerating insert to enable the toner movement (flow) from the funnel at the bottom of the toner hopper into the cartridge being filled. This process over aerates the toner deistically increasing its volume. To densify the toner inside the cartridge, an air evacuation element (a suction rod) is inserted through a second opening (in addition to the toner filling opening), and this air evacuation system needs to be airtight for the air removal to work. Also, it is required in Ichikawa to have a filter between the vacuum or suction rod and the source of vacuum to separate the entrained toner particles.

In U.S. Pat. No. 6,497,259 (Wegman), an apparatus is provided for moving powder from a hopper containing a supply of powder to fill a container. The apparatus includes (a) a conduit member operably connected to the hopper and having a discharging end for permitting a powder to be moved therethrough; (b) a nozzle member for directing the powder from the conveyor to fill the container, the nozzle member being operably connected to the discharge end of the conduit member and having a first end connected to the conduit member, and a second and opposite end for dispensing moving powder into the container, and (c) a conveyor device located at least partially within the conduit member for moving the powder from the hopper in a powder-moving direction to the nozzle member, the conveyor device being stoppable for halting the flow of powder, and including a porous portion and vacuum device for additionally halting the flow of powder for a clean shutoff. In Wegman, a porous tip is connected to the end of an auger and by the vacuum supplied through the hollow auger creates a vacuum field compacting the toner or powder in this area, thus creating a plug that stops the toner flow (dribbling) when the auger is not rotating between the filling cycles.

SUMMARY

The present disclosed embodiments provide an improvement in the toner or particulate material filling process by conditioning the density of the toner mass in the cartridge or container. In the present device and system, a porous tube connected to a negative (vacuum) and positive pressure sources through a three-way valve is inserted in and withdrawn from a cartridge through a hollow auger and a hollow auger-holding shaft. Only one opening in the cartridge is needed, i.e. for the auger to enter the cartridge and having the porous tube in the auger. The present system does not need to be airtight and the porous tube does not need to move with the raising level of toner in the cartridge. The present system cannot only densify the toner by evacuating the excessive air, but it can also inject the air into filled toner making it more fluid inside the cartridge or container at times during the filling cycle. This is sometimes needed in specially shaped or double chamber or irregularly shaped cartridges to encourage toner flow between the chambers. The porous tube moves axially in the hollow auger shaft and does not rotate. This system uses a porous tube to remove air mass during the filling operation which allows the toner cartridge to be filled to a higher density. The porous tube, as noted earlier, is inserted through a hollow portion of the auger, thus only requiring one hole or opening in the cartridge for the auger and the contained porous tube. Limiting to one opening is desirable since it only requires one plugging after the filling operation is completed. Also, this will significantly increase the toner filling and cartridge volume utilization.

The porous tube used in the present embodiment can be made from any suitable material such as "Porex" which is a trademark of Porex Corporation of Fairburn, Ga. Also included as materials for said porous tube are suitable microporous material selected from the group consisting of porous polymers, powdered metal, microscopically perforated metal sheets, microscopically perforated plastic, microscopically perforated cellulose, sintered metal oxides, and mixtures thereof. The micropores in these microporous materials are randomly distributed and produce micro-air jets, which project their respective gas streams randomly toward the interior hollow chamber. All of these above materials will be referred to in this disclosure and in the claims as "a gas permeable microporous material", and as the material or "air removing tube" or "porous tube". The advantage of having a separate, movable porous tube rather than a small part of the auger being porous is when the porous tube is independent of and not part of the auger, it can be removed when the auger is operational and it could remove air when the auger is not operational. Also, as the toner rises in the process of filling in the cartridge, the porous tube can remain deep in the toner mass continuing to remove air from the toner mass. The porous tube also can be moved to any position in the cartridge no matter where the auger is positioned. In addition, a continuous porous tube attached to a vacuum will have a greater vacuuming effect, more than a merely porous tip on an auger. These are the advantages the present system offers with an independent porous tube having pours throughout its length providing a greater vacuum and fosters vacuum more than a porous auger tip.

The present embodiments provide a filling system for conveying and feeding particulate material from a hopper for holding the material into a container. This system comprises a container, a transport adapted to operatively move the particulate material from the hopper to the container, and a source of vacuum. The transport comprises an auger operatively connected to the hopper and the container. The auger has a hollow portion in its body and an air-removing tube inserted through this hollow portion to form a tube-containing auger. The air-removing tube is operatively connected to the source of vacuum and is adapted to contact the particulate material during the filling operation. In this system the tube is enabled to supply a vacuum to the particulate material and will remove air from the particulate material. The auger is a hollow-shaft auger containing the tube to allow deaeration of the particulate material inside the container during the filling operation. The container has one opening through which the tube-containing auger is inserted. This tube-containing auger is enabled to both transport particulate material into the container and deaerate the particulate material while in the container through the porous tube. In this system, during the filling operation, an air cylinder is adapted to lower the tube into a mass of the particulate material. In this system, the source of vacuum is adapted to be turned on and off in a predetermined frequency.

Thus, disclosed herein are embodiments related to an apparatus for moving toner from a hopper to a cartridge or container during a toner-filling operation. This apparatus comprises a hopper containing the toner, a cartridge, a transport adapted to move the toner from the hopper to the cartridge, and a source of vacuum. The transport comprises an auger operatively connected to the hopper and the cartridge. The auger has a hollow portion through substantially its entire body and has inserted in its hollow portion an air-removing tube or porous tube to form a tube-containing auger. This air-removing tube is operatively connected to a source of vacuum and is adapted to movably contact the toner during the filling operation. The apparatus provides this porous tube, which is made from a material selected from the group consisting of porous polymers, powdered metal, microscopically perforated cellulose, sintered metal oxides and mixtures thereof. Any suitable material can be used to make this porous tube including "Porex". Obviously, the porous tube is operatively connected to the source of vacuum. This porous tube is also operatively connected to a hollow air cylinder metal rod. The air cylinder metal rod is adapted to convey a vacuum pressure from the source of vacuum or compressed air to the porous tube. This hollow metal rod is operatively connected between the porous tube and the source of vacuum, and the hollow rod in one embodiment has a flexible hose connecting it to a source of vacuum and compressed air through a source switching device like a three-way valve.

To summarize, the embodiments presently disclosed comprise an apparatus for filling a cartridge with toner during a filling operation. This apparatus comprises in operative relationships a toner-containing hopper, a source of vacuum, an auger located in operative contact with the hopper and adapted to move a toner mass from the hopper to a cartridge. The auger is inserted into the cartridge via a single opening in the cartridge. There is a gas-permeable porous tube inserted through a hollow portion of the auger and adapted to be movably positioned therein. This porous tube is operatively connected at one end to the source of vacuum and its opposite end extends beyond the lowest portion of the auger and contacts the toner during the filling operation. This porous tube is adapted to supply a vacuum to the toner mass to remove air from the toner mass during the filling operation. The porous tube is in operative contact with a hollow flexible tube. This hollow flexible tube is on one end in operative contact with the source of vacuum and on its other end with the porous tube through a hollow air cylinder rod. The porous tube of these embodiments is made from a micro porous material with microspores having an average pore diameter of from about 7 to 250 microns. The average pore diameter of pores in the porous tube is from about 0.01 to about 1,000 percent of the average diameter size of the toner during the filling operation.

DETAILED DISCUSSION OF DRAWINGS AND PREFERRED EMBODIMENTS

Figure 1:
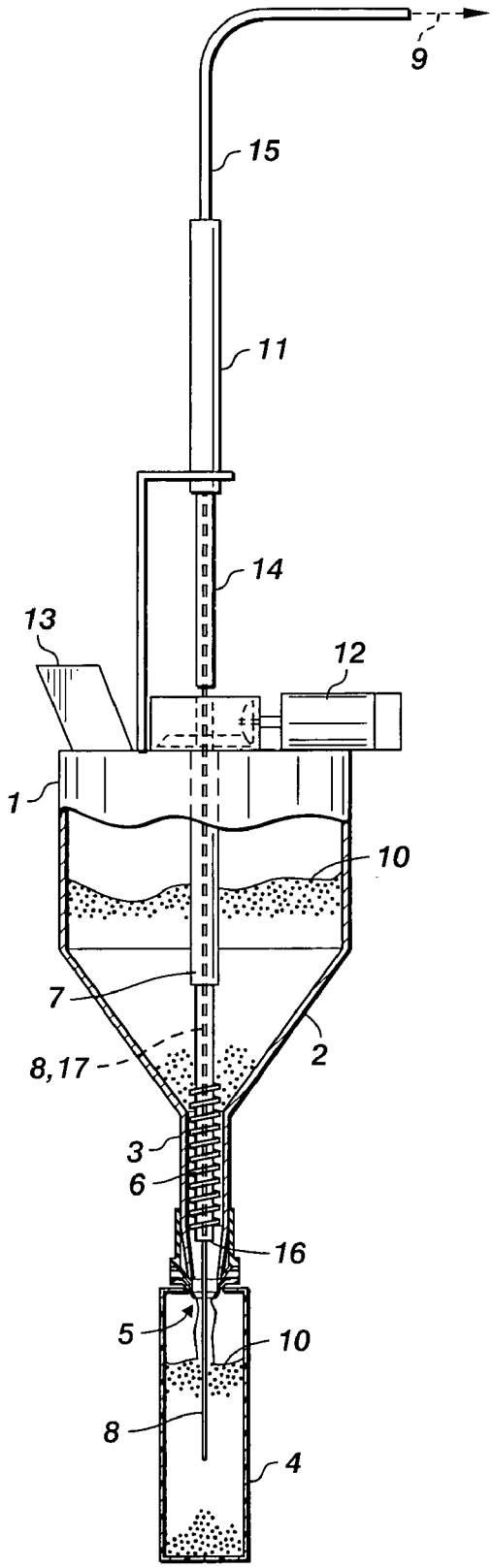
FIG. 1 illustrates the apparatus embodiment of the disclosed system for filling of a canister with the toner during the filling operation.

In FIG. 1, the system is shown during the toner (or particulate material) filling operation where a hopper 1 containing toner is provided with a bottom funnel-like section 2. The funnel 2 will have a conduit 3, which is operatively connected to a cartridge 4 via cartridge opening 5. An auger 6 is disposed through the hopper 1 and extends down to the opening 5 where it transports toner 10 from the hopper 1 to the cartridge 4 during a filling operation. Auger 6 is operatively connected to an auger device shaft 7 that supplies power and movement to the auger 6. Auger 6 has a hole drilled through its length to provide a space for a porous tube 8 to be inserted therethrough. The porous tube 8 is connected to a source of vacuum 9 to allow porous tube 8 to remove air from the toner mass 10 while it is in cartridge 4 during the filling operation. The porous tube 8 can be made from any suitable material such as porous polymers, powdered metals, microscopically perforated cellulose, sintered metal oxides and any suitable mixture of these materials. The porous tube 8 removes air from the toner mass 10 to densify the toner in cartridge 4 and allow more toner 10 to be packed into the cartridge 4. This allows for a reduction of the size of a normal cartridge with a greater toner density. As the air is removed from toner 10 by the porous tube 8, the resulting reduced internal pressure in cartridge 4 permits more toner 10 to flow into the cartridge 4. The vacuum 9 in an embodiment is connected to a hollow air cylinder rod 14 which is operatively connected to porous tube 8 so as to provide a vacuum to porous tube 8. A motor 12 may be positioned in any suitable location to provide power to the system and to auger 6 during the filling operation. The hopper 1 has a toner inlet 13 where a sufficient amount of toner 10 (or particulate material) can be supplied as needed. The porous tube 8 can operate with compressed air as well as vacuum to either aerate or deaerate the toner 10 during the filling operation. This disclosure or description, however, will be directed to provide a vacuum for clarity of these embodiments.

Thus, the porous tube 8 can supply a vacuum or compressed air to the toner 10 depending upon the desired results. Therefore, the pressure used is selected from the group consisting of compressed air and vacuum.

Figure 2:
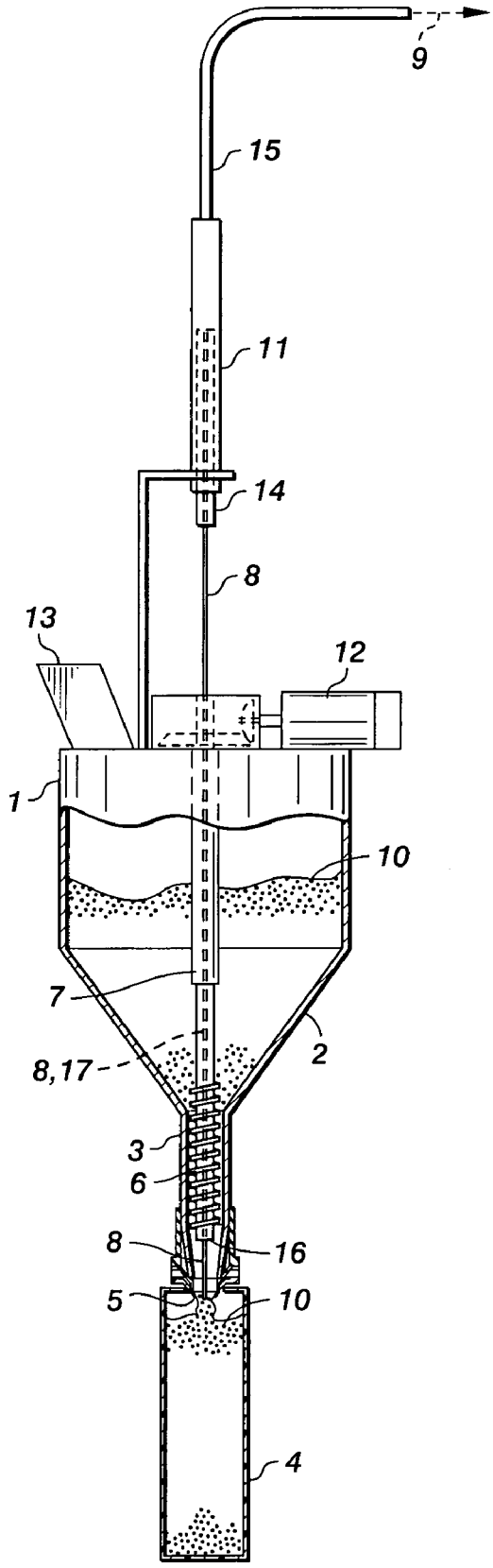
FIG. 2 illustrates the apparatus or system of one embodiment after the filling operation.

In FIG. 2, to practice an embodiment, one will insert a tube 8 made from porous material like "Porex" through the hole 17 drilled through the body of an auger 6 and an auger driving shaft 7 (see FIGS. 1 and 2). The porous tube 8 is attached to a hollow air cylinder rod 14 of cylinder 11. A hose 15 connects to the hollow rod 14 to a controllable vacuum source 9. The auger/shaft hole 17 diameters are bigger than the porous tube 80D to ensure free movement inside the auger 6—shaft system. Thus, while the cartridge 4 is being filled, the air cylinder 11 lowers the porous tube 8 into the mass of the aerated toner 10. The vacuum 9 is then turned ON and OFF in a predetermined frequency which is most suitable for a given toner and level of aeration. This will suck out (evacuate) the excessive air and lower the level of toner 10 in the cartridge 4. At the very end of the filling cycle, the vacuum 9 is turned off and the cylinder retracts the porous tube 8 from deep in the toner mass 10 to a position completely inside the auger 6 before the filling device and cartridge 4 are separated. After that the system is ready for the next filling cycle. Alternatively, the porous tube 8 may be movably extracted as the toner 10 level increases during filling.

Figure 3A:
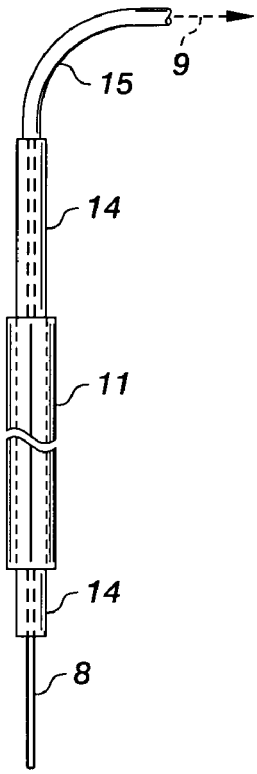
FIG. 3 illustrates various porous connections to vacuum source.
Figure 3B:
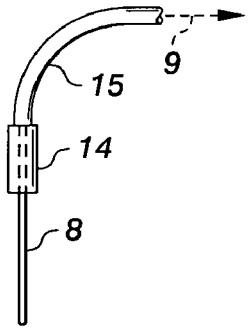
Figure 3C:
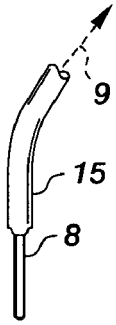

In FIG. 3, porous tube 8 can be connected to vacuum source 9 by any suitable manner such as shown in FIGS. 3A, 3B and 3C. In FIG. 3A, porous tube 8 is, in one embodiment, connected to a hollow steel rod 14 of an air cylinder 11 which in turn is connected to a flexible hose 15. In FIG. 3B, porous tube 8 is operatively connected to hollow steel tube 14 which in turn is operatively connected to source of vacuum 9 through a flexible hose 15. In FIG. 3C, the porous tube 8 is connected directly to the source of vacuum 9 through a flexible hose 15.

Figure 4:
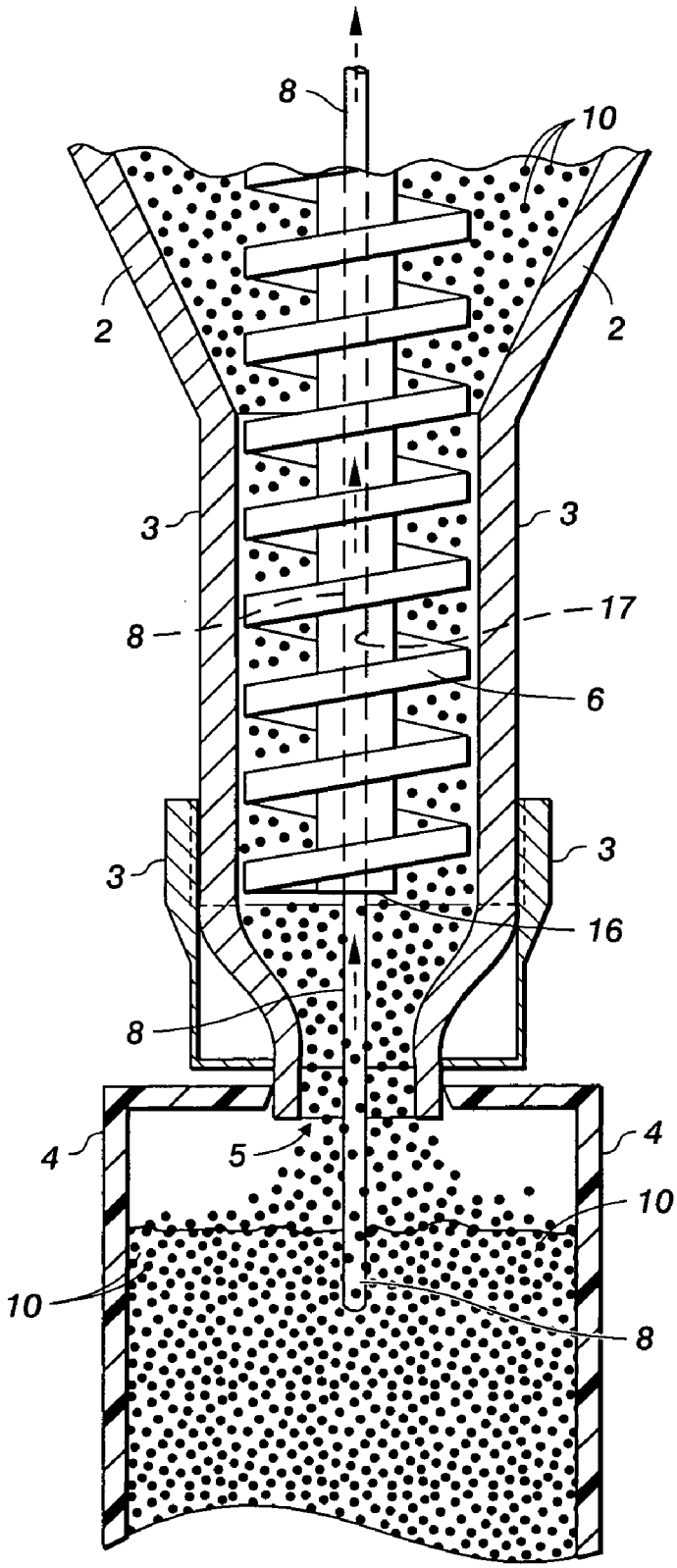
FIG. 4 illustrates an embodiment with an expanded view of the lowest section of the auger and the porous tube extending beyond this lowest section.

In FIG. 4 the lower portion of an embodiment is shown where the lowest portion of auger 6 extends close to a fill opening 5 in the cartridge 4. Here the auger 6 transports the toner mass or toner 10 from a hopper 1 (not shown) to a cartridge 4. The lowest portion 16 of auger 6 ends near the fill opening 5, however, porous tube 8 extends beyond the end or lowest portion 16 of auger 6 and contacts the toner mass 10. Thus, more and faster deaeration of the toner will result when the entire length of porous tube 8 will cause deaeration and the porous tube will operate at various depths of toner.

This embodiment, where the porous tube 8 contacts more toner mass and where the porous tube 8 extends way beyond the tip or lowest portion 16 of the auger, results in a more effective, faster and more complete deaeration of toner mass 10.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A filling system for conveying and feeding particulate material from a hopper for holding said material into a container, said system comprises said container, a transport adapted to operatively move said particulate material from said hopper to said container, and a source of vacuum, said transport comprising an auger operatively connected to said hopper and said container, said auger having a hollow portion in its body and an air-removing porous tube inserted through said hollow portion to form a tube-containing auger, said air-removing porous tube operatively connected to said source of vacuum and adapted to movably extend beyond a lowest portion of said auger and contact said particulate material during a filling operation.

2. The system of claim 1 wherein said tube is adapted to remove air from said particulate material.

3. The system of claim 1 wherein said auger is a hollow-shaft auger containing said tube to allow deaeration of said particulate material inside said container during said filing operation.

4. The system of claim 1 wherein said container has one opening through which said tube-containing auger is adapted to be inserted, said tube-containing auger enabled to both transport particulate material into said container and deaerate said material while in said container.

5. The system of claim 1 wherein during said filling operation, an air cylinder is adapted to lower said tube into a mass of said particulate material.

6. The system of claim 1 wherein said source of vacuum is adapted to be turned on and off in a predetermined frequency.

7. An apparatus for moving toner from a hopper to a cartridge or container during a toner-filling operation, said apparatus comprising a hopper containing said toner, a cartridge, a transport adapted to move said toner from said hopper to said cartridge, and a source of vacuum, said transport comprising an auger operatively connected to said hopper and said cartridge, said auger having a hollow portion through substantially its entire body, and having inserted in said hollow portion an air-removing porous tube or porous tube to form a tube containing auger, said air-removing porous tube operatively connected to said source of vacuum and adapted to movably extend beyond a lowest portion of said auger and contact various depths of said toner during said filling operation.

8. The apparatus of claim 7 wherein said porous tube is made from a material selected from the group consisting of porous polymers, powdered metal, microscopically perforated cellulose, sintered metal oxides, and mixtures thereof.

9. The apparatus of claim 7 wherein said porous tube is made from "Porex".

10. The apparatus of claim 7 wherein said porous tube extends beyond a lowest portion of said auger and is operatively connected to said source of vacuum.

11. The apparatus of claim 7 wherein said porous tube is operatively connected to a hollow air cylinder metal rod, said air cylinder metal rod adapted to convey a vacuum pressure from said source of vacuum to said porous tube.

12. The apparatus of claim 7 wherein a hollow rod metal is operatively connected between said porous tube and said source of vacuum, said hollow rod having a flexible hose connecting it to said source of vacuum.

13. An apparatus for filling a cartridge with toner during a filling operation, said apparatus comprising in operative relationships a toner-containing hopper, a source of vacuum, and auger located in operative contact with said hopper and adapted to move a toner mass from said hopper to a cartridge, said auger inserted into said cartridge via an opening in said cartridge, a gas permeable porous tube inserted through a hollow portion of said auger and adapted to be movably positioned therein, said porous tube operatively connected at one end to said source of vacuum and its opposite end enabled to movably extend beyond a lowest portion of said auger and contact said toner at various depths during said filling operation, said porous tube adapted to supply a vacuum to said toner to remove air from said toner mass during said filling operation, said porous tube in operative contact with a hollow flexible tube, said hollow flexible tube on one end in operative contact with said source of vacuum and on its other end with said porous tube.

14. The apparatus of claim 13 wherein said porous tube is made from a material selected from the group consisting of porous polymers, powdered metal, microscopically perforated cellulose, sintered metal oxides, and mixtures thereof.

15. The apparatus of claim 13 wherein said porous tube is made from "Porex".

16. The apparatus of claim 13 wherein said porous tube extends beyond the lowest portion of said auger and is operatively connected to a pressure source selected from the group consisting of a vacuum and compressed air.

17. The apparatus of claim 13 wherein said porous tube is operatively connected to a hollow air cylinder metal rod, said air cylinder metal rod adapted to convey a vacuum pressure from said source of vacuum to said porous tube.

18. The apparatus of claim 13 wherein a hollow rod metal is operatively connected between said porous tube and said source of vacuum, said hollow rod having a flexible hose connecting it to said source of vacuum.

19. The apparatus of claim 13 wherein said porous tube is made from a microporous material with micropores having an average pore diameter of from about 7 to 250 microns.

20. The apparatus of claim 13 wherein an average pore diameter of pores in said porous tube are from about 0.01 to about 1,000 percent of the average diameter size of the toner during said filling operation.

* * * * *